United States Patent [19]

Steiner

[11] 3,963,809

[45] June 15, 1976

[54] VACUUM CONTROLLED FUEL METERING DEVICE

[76] Inventor: Alois Steiner, 250 Sixth Ave., St. Petersburg, Fla. 33701

[22] Filed: Dec. 1, 1975

[21] Appl. No.: 636,430

[52] U.S. Cl. ..... 261/69 R; 137/512.2
[51] Int. Cl.[2] ..... F02M 7/04
[58] Field of Search ..... 261/69 R; 137/512.2

[56] References Cited

UNITED STATES PATENTS

| | | | |
|---|---|---|---|
| 213,186 | 3/1879 | Gassett | 137/512.2 |
| 2,321,211 | 6/1943 | Johnson | 261/69 R |
| 2,447,264 | 8/1948 | Beardsley, Jr. | 261/69 R |
| 2,823,021 | 2/1958 | Sternaman | 261/69 R |
| 2,960,996 | 11/1960 | Haselton | 137/512.2 |
| 3,207,490 | 9/1965 | Sterner et al. | 261/69 R |
| 3,233,878 | 2/1966 | Phillips | 261/69 R |

*Primary Examiner*—Tim R. Miles
*Attorney, Agent, or Firm*—Clarence O'Brien; Harvey B. Jacobson

[57] ABSTRACT

A vacuum controlled liquid metering assembly is provided defining an upstanding fluid passage therethrough communicated with the source of fluid at its lower end and with a source of variable vacuum at its upper end. A plurality of valve members are freely reciprocal in the passage between upper and lower limit positions and each is loosely received in the passage. In addition, each of the valve members has an upstanding bore formed therethrough and the bores of the valve members are vertically aligned. The valve members are of different weight with the heaviest valve member disposed lowermost and the lightest valve member disposed uppermost. Also, the diameters of the passages or bores formed through the valve members are each larger in diameter than the bore or passage disposed immediately thereabove. Still further, the valve members may be buoyed up in their confining upstanding fluid passage in response to greater fluid pressures therebelow and dynamic fluid pressures acting upon them from therebelow.

6 Claims, 5 Drawing Figures

Alois Steiner

INVENTOR.

BY Clarence A. O'Brien and Harvey B. Jacobson Attorneys

VACUUM CONTROLLED FUEL METERING DEVICE

BACKGROUND OF THE INVENTION

Various forms of metering devices previously have been designed including some specifically adapted for use as means to variably meter the flow of fuel to a fuel and air mixture charge forming area. Examples of previous structures of this type including features at least somewhat similar to those used in this invention are disclosed in U.S. Pat. Nos. 213,186, 2,321,211, 2,447,264, 2,823,021, 2,960,996, 3,207,490 and 3,233,878. However, these previously patented devices are not capable of precise fluid flow control by the use of only simple basic structural elements.

BRIEF DESCRIPTION OF THE INVENTION

The vacuum controlled fuel metering device of the instant invention includes structure for precise control of the passage of fluid therepast in that the cross-sectional areas of the vertically stacked and shiftable valve members is substantially constant from the uppermost valve member to the lowermost valve member except that the cross-sectional area of each valve member of the instant invention is slightly less than the cross-sectional area of the valve member disposed immediately thereabove. Accordingly, not only is a greater pressure differential required to buoy up each successive lower valve member, but a greater dynamic fluid pressure is required to buoy up each successive lower valve member.

The fuel metering device of the instant invention has been designed to provide a means whereby liquid fuel and air may be readily mixed in proper proportions in order to form a combustible mixture or charge for an internal combustion engine.

Although the metering device is illustrated and described hereinafter as being designed primarily for use in conjunction with an internal combustion engine such as that presently utilized on motor vehicles, it is to be understood that the fuel metering device may also be utlized to form combustible mixtures or charges in other environments.

Conventional automotive carburetors rely basically upon reduced air pressure of the discharge end of the fuel line opening into an air passage through the carburetor body in order to deliver at least generally correct amounts of liquid fuel into the air being drawn into the carburetor body and into an associated internal combustion engine. However, this principle of relying solely upon reduced venturi area pressures has been found to only approach the desired optimum performance in the low and mid-range engine speed.

This operating characteristic of basic present-day carburetor construction is at least to a great degree caused by the inability of reduced venturi area pressures to draw sufficient fuel through a fixed fuel metering apparatus at high engine speeds. Most carburetors are provided with main jets which have fuel passages formed therethrough of fixed cross-sectional areas and venturi area reduced pressures are unable to draw sufficient fuel to these fuel metering passages at high engine speeds. Consequently most present-day carburetors are provided with a plurality of air induction and venturi passages which are successively opened and have fuel discharged into each of the throttle controls of the carburetor are moved toward the full open positions.

While this solution to the problem of lean mixtures at high engine operating speeds is effective, utilization of this method of preventing an air and fuel mixture of an internal combustion engine from becoming too lean at high engine speed results in more complicated carburetor constructions whose various air and fuel flow controlling components must be carefully synchronized and periodically serviced.

Accordingly, it is a main object of this invention to provide an extreme simple fuel metering device which may be utilized in conjunction with basic automotive carburetor constructions to produce a correct air and fuel mixture or charge for the associated internal combustion engine, throughout its entire range of operating speeds above idle speed.

Another object of this invention is to provide a fuel metering device in accordance with the preceding object and which may be readily constructed in various sizes and cross-sectional configurations for use in conjunction with single as well as high performance multi-barrel carburetors.

A still further object of this invention is to provide a fuel metering device and a companion carburetor assembly which will be capable of functioning over long periods of time without the usual maintenance servicing due to the absence of numerous parts which are required by conventional carburetors.

Another object of this invention is to provide a device in accordance with the preceding objects which will be more effective in cold weather starting in that it will be capable of delivering considerably greater quantities of extra fuel during choking operations.

A further object of this invention is to provide a carburetor construction in accordance with the preceding objects which will be less susceptible to flooding the associated internal combustion engine due to fuel percolation subsequent to engine-shutoff after the associated engine has been operating at high temperatures.

The final object of this invention to be specifically enumerated herein is to provide a fuel metering device in accordance with the preceding objects which will conform to conventional forms of manufacture, be of simple construction and dependable in operation so as to provide a device that will be economically feasible, long lasting and relatively trouble-free.

These together with other objects and advantages which will become subsequently apparent reside in the details of construction and operation as more fully hereinater described and claimed, reference being had to the accompanying drawings forming a part hereof, wherein like numerals refer to like parts throughout.

DETAILED DESCRIPTION OF THE INVENTION

Figure 1:
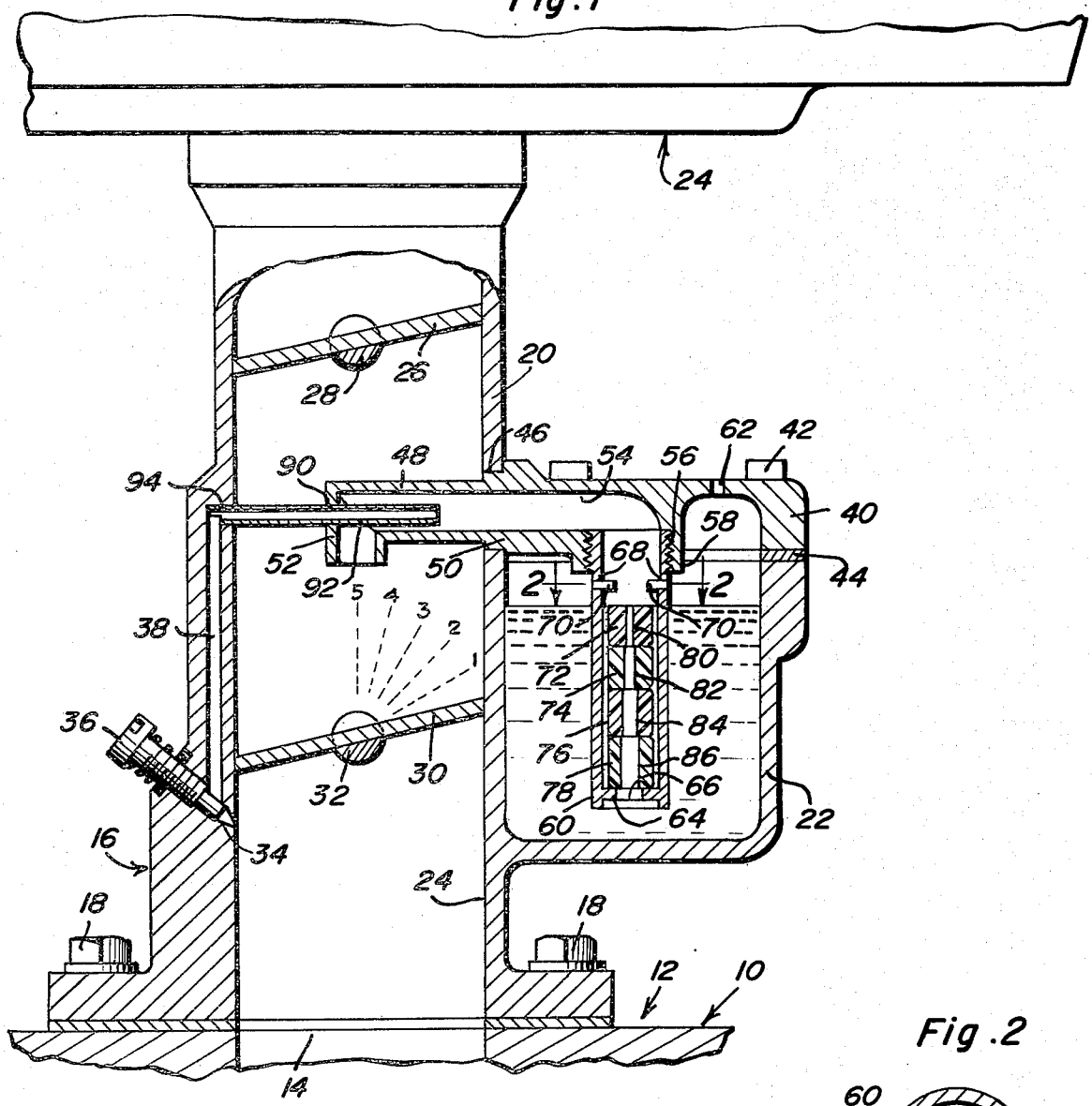
FIG. 1 is a fragmentary side elevational view of the intake manifold portion of a conventional form of internal combustion engine with the carburetor constructed in accordance with the present invention and incorporating therein the fuel metering device of the instant invention mounted atop the intake manifold between the latter and the air cleaner mounted atop the carburetor, the carburetor and fuel metering device of the instant invention being illustrated in vertical section.
Figure 2:
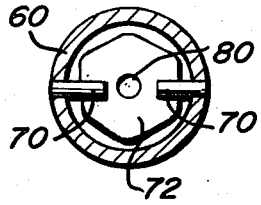
FIG. 2 is an enlarged horizontal sectional view taken substantially upon the plane indicated by the section line 2—2 of FIG. 1.

Referring now more specifically to the drawings, the numeral 10 generally designates an internal combustion engine of conventional design including an intake manifold referred to in general by the reference numeral 12. The manifold 12 has an air and fuel mixture induction passage 14 formed therein including an inlet end over which a carburetor constructed in accordance with the present invention and generally referred to by reference numeral 16 is secured in any convenient manner such as by fasteners 18.

The carburetor 16 is conventional to the extent that it includes a body 20 defining a float chamber 22 and an air and fuel passage 24 therethrough. The upper end of the passage 24 defines the inlet end thereof and the lower end defines the outlet and thereof. The upper end of the carburetor body 20 includes an air cleaner of conventional design and generally designated by reference numeral 25 secured over the inlet end of the passage 24 and the upper end portion of the passage 24 has either an automatic or manually actuated butterfly choke valve member 26 disposed therein. The choke valve member 26 is mounted on a rotatable diametric shaft 28 journalled through the body 20 on a diameter of the passage 24 and the body 20 further includes a lower throttle butterfly valve 30 mounted upon a shaft 32 journalled through the body 20 also on the diameter of the passage 24. The shaft 32 may have any suitable form of throttle linkage (not shown) operatively connected thereto for oscillating the shaft 32 and thus the throttle valve 30.

The carburetor 16 further includes an idle fuel oulet port 34 with which a needle valve 36 threadedly supported from the body 20 is operatively associated and the body 20 includes an idle fuel passage 38 extending vertically therealong with its lower end communicated with the port 34, as controlled by the needle valve or idle screw 36.

The float bowl or chamber 22 includes a removable top wall 40 secured to the body by means of suitable removable fasteners 42 and the top wall or cover 40 includes a gasket 44 by which a sealed connection between the top wall 40 and the bowl defining portion of the body 20 is formed.

The foregoing may be considered conventional carburetor construction and it is to be understood that the improvements of the instant invention are described hereinafter.

The body 20 includes a horizontal lateral bore 46 formed therethrough which opens into the passage 24 intermediate the choke valve 26 and the throttle valve 30. The top wall or cover 40 includes a tubular outlet neck portion 48 provided with an enlargement 50 on its base end snugly received within the bore 46. The neck portion 48 projects generally radially into the center of the passage 24 and includes a downturned discharge end 52 which opens downwardly at the outer end of the passage 54 extending through the neck portion 48.

The inlet end of the passsage 54 opens downwardly into a downwardly opening threaded counterbore 56 formed in a depending boss 58 carried by the top wall or cover 40 and the upper end of an upstandng fuel pickup sleeve 60 is threaded into the threaded counterbore 56 for support of the sleeve 60 from the cover or top wall 40.

The top wall or cover 40 includes a small diameter vent port 62 and the lower end of the sleeve 60 is provided with a lower end wall 64 having a central aperture 66 formed therein. In addition, the upper end portion of the sleeve 60 is provided with a pair of diametrically opposite radial bores 68 in which the outer ends of radially inwardly projecting stop pins 70 are anchored in any convenient manner. A plurality of vertically stacked valve members 72, 74, 76 and 78 are disposed in the sleeve 60 between the lower end or bottom wall 64 thereof and the stop pins 70. The valve members 72, 74, 76 and 78 have vertically registered upstanding bores 80, 82, 84 and 86, respectively, formed therethrough and each of the valve members is hexagonal in horizontal cross-sectional shape, although other polygonal shapes could be utilized if desired.

Each of the bores 82, 84 and 86 is slightly larger in diameter than the corresponding bore disposed immediately thereabove and each of the valve members 74, 76 and 78 is slightly heavier than the valve member disposed immediately thereabove. Also, inasmuch as the bores through the valve members increase in diameter with each lower valve member, the horizontal cross-sectional area of each of the valve members 74, 76 and 78 is slightly smaller than the cross-sectional area of the valve member disposed immediately thereabove.

The end of the neck portion 48 farthest from the threaded counterbore 56 is provided with a small diameter horizontal bore 90 and the inlet end of a supply tube 92 projects through the bore 90 and into the interior of the neck 48. The outlet end of the supply tube 92 extends to the wall portion of the body 20 remote from the bore 46 and is snugly received in a horizontal laterally inwardly directed upper terminal end portion 94 of the passage 38. Accordingly, the idle fuel passage 38 is operative to receive idle fuel from within the neck 48, although other means of supplying fuel to the passage 38 from the float chamber 22 may be utilized, if desired. Further, although the port 34 is illustrated as slightly spaced below the lowermost portion of the throttle valve 30 when the latter is in the closed position thereof illustrated in FIG. 1 of the drawings, the port 34 may be located anywhere along the wall of the passage 24 below the closed position of the throttle valve 30.

In operation, when the throttle valve 30 is in the closed position thereof illustrated in FIG. 1 of the drawings or rotated slightly in a counterclockwise direction from the closed position illustrated in FIG. 1, the associated engine 10 will be operating at idle speeds and sufficient fuel for maintaining the engine 10 at idle speeds supplied to the passage 24 through the port 34. The idle fuel is drawn by engine vacuum into the passage 38 through the supply tube 92 and if desired, the inlet end of the supply tube 92 may open directly into the fuel or float chamber 22 below the level of fuel therein.

However, as the throttle valve 30 is rotated further in a counterclockwise direction toward the vertical full open position thereof, larger amounts of air pass downwardly through the passage 24 past the discharge end 52 of the neck 48 and create a partial vacuum at the outlet end of the passage 54. This partial vacuum causes liquid fuel from within the chamber 22 to be drawn upwardly through the bores 66, 86, 84, 82 and 80 and into the passage 54 for discharging from the outlet end 52 thereof into the passage 24. Of course, as the operating temperature of the engine 10 increases, either automatic or manual control of the choke valve 26 will be actuated to swing the choke valve 26 toward the vertical open position thereof. This of course will in turn allow greater quantities of air to pass downwardly through the passage 24 and yet reduce the engine vacuum in the passage 24 above the throttle valve 30 and therefore reduce the amount of fuel drawn upwardly through the valve members and into the passage 54. In this manner, as soon as the choke valve member 26 is moved toward its open position, the fuel and air mixture formed in the passage 24 has its percentage of fuel reduced.

Figure 3:
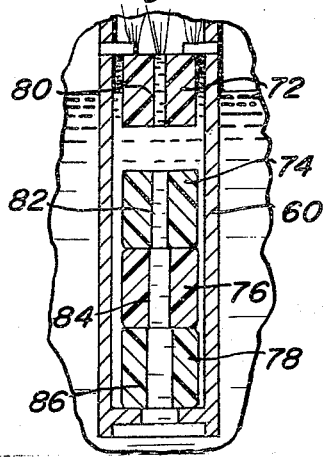
FIG. 3 is an enlarged vertical sectional view of the portion of the carburetor comprising the present invention and with the fuel metering components of the metering device disposed in their operative positions which they assume during operation of the engine at slow speed.
Figure 4:
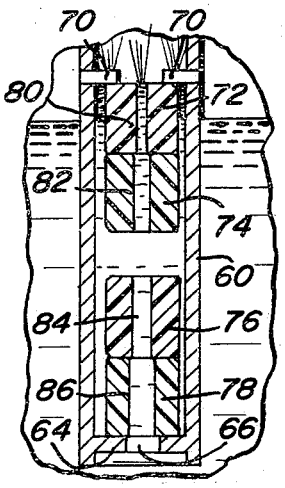
FIG. 4 is a fragmentary vertical sectional view similar to FIG. 3 but with the fuel metering components of the instant invention illustrated in the positions thereof during intermediate speed operation.
Figure 5:
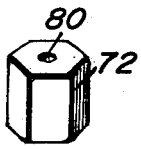
FIG. 5 is a perspective view of the uppermost fuel metering component illustrated in FIGS. 1 through 4.

However, as the throttle valve 30 is swung still further in a counterclockwise direction toward the open position, the velocity of air passing downwardly through the passage 24 is increased sufficiently to create a greater partial vacuum at the discharge end of the passage 54 which will in turn create a greater differential in pressure above and below the valve members in the sleeve 60 and cause the lightest uppermost valve member 72 to be buoyed up to the position thereof illustrated in FIG. 3 of the drawings whereby fuel from below the fuel level in the bowl 22 will not only pass upwardly through the bores formed through the valve members but also about the outside of the uppermost valve member 72. Thus, the fuel passing by the valve member 72 is not only passing through the bore 80 but also about the outside of the valve member 72 and the diameter of the bore 82 formed in the valve member 74 then comprises the greatest restriction to fuel flow upwardly through the sleeve 60. As the throttle valve 30 is further rotated to the open position and inlet air passes at greater velocity through the passage 24, successive lower valve members are buoyed up in the sleeve 60 not only by pressure differential but also by dynamic fluid pressures acting thereupon from below. In FIG. 4 of the drawings the two uppermost valve members 72 and 74 have been buoyed upward and thus the bore 84 formed through the valve member 76 comprises the basic restriction to fuel flow upwardly through the sleeve 60. Then, as the valve member 76 is buoyed upward the bore 86 formed through the valve member 78 comprises the basic restriction to fuel flow upwardly through the sleeve 60. Finally, when the engine is operating at high speeds and with the throttle valve 30 in the full open position, the lowermost valve member 78 is buoyed upward and the bore 66 which is slightly larger in diameter than the bore 86 comprises the primary restriction to the flow of the fuel upwardly through the sleeve 60.

Of course, the number of valve members may be increased or decreased as desired. However, it has been found that at least four valve members should be utilized in order that the increase in fuel flow upwardly through the sleeve 60 may be accomplished in gradual increments. Further, the phantom line positions of the throttle valve 30 in FIG. 1 numbered 1 through 4 represent those approximate positions of the throttle valve when the valve members 72, 74, 76 and 78, respectively, are lifted to their uppermost limit positions and therefore, the correct air-fuel ratio is provided throughout movement of the throttle valve 30 from the idle position to the full throttle position.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a carburetor body of the type including a tubular portion defining an air and fuel mixture passage extending through said body, said body defining a float chamber along one side of said passage, a fuel delivery passage communicated at one end with the interior of the fuel chamber above the fuel level therein and at the other end with the interior of said mixture passage, an upstanding body in said chamber defining an upstanding fluid passage therethrough whose upper end is in sealed communication with the inlet end of said delivery passage and whose lower end opens outwardly into said chamber below the fuel level therein, said fluid passage being provided with a centrally apertured seat in its lower end, a plurality of vertically stacked pressure differential and fluid dynamic pressure valve members disposed in said fluid passage for free independent reciprocation therein between upper limit positions and lower limit positions defined by seated engagement of the lowest valve member with said seat and each valve member with the valve member immediately therebelow, said valve members having vertical bores formed therethrough aligned with each other and the aperture in said seat, said valve members each including peripherally spaced outer side guide surface portions spaced further radially outwardly from the corresponding bore than the remaining outer side surfaces of said valve members for guiding engagement with the inner surfaces of said fluid passages and for minimum surface to surface guiding contact between said valve members and the inner surfaces of said fluid passage.

2. The combination of claim 1 wherein each lower bore is greater in diameter than the bore disposed thereabove.

3. The combination of claim 1 wherein said valve members equal at least four in number.

4. The combination of claim 1 wherein the frontal area of each lower valve member facing in a downward upstream direction in less than the frontal area of the valve member disposed thereabove.

5. The combination of claim 1 wherein each lower valve member is heavier than the valve member disposed thereabove.

6. The combination of claim 5 wherein said valve members are hexagonal in cross-sectional shape and the apices thereof between adjacent outerside surfaces comprise said guide surface portions.

* * * * *